US005213144A

United States Patent [19]

Campbell et al.

[11] Patent Number: 5,213,144

[45] Date of Patent: May 25, 1993

[54] VALVE OPENING DEVICE

[75] Inventors: George D. Campbell, Camlachie; James G. Barron, Corunna, both of Canada

[73] Assignee: Polysar Rubber Corporation, Sarnia, Canada

[21] Appl. No.: 896,943

[22] Filed: Jun. 11, 1992

[30] Foreign Application Priority Data

Dec. 2, 1991 [CA] Canada ..... 2056792

[51] Int. Cl.[5] ..... B65B 1/04; B67C 3/00

[52] U.S. Cl. ..... 141/383; 141/65; 141/67; 141/392; 141/1; 251/148

[58] Field of Search ..... 141/65, 67, 312, 346, 141/351, 352, 383, 392, 1; 137/38, 39, 43; 251/148, 291; 220/212; 215/228, 231

[56] References Cited

U.S. PATENT DOCUMENTS 4,180,272 12/1979 Heitz ..... 141/312

4,699,190 10/1987 Bates ..... 141/65

*Primary Examiner*—Henry J. Recla

*Assistant Examiner*—Steven O. Douglas

*Attorney, Agent, or Firm*—Joseph C. Gil; Godfried R. Akorli

[57] ABSTRACT

A device is provided for attachment to a pressure tank car for use for the removal of the contents of the tank car in the situation when the tank car is damaged or overturned, said device comprising a metallic tubular assembly attached to a valve on the tank car said tubular assembly containing a relatively inflexible rod-like elongate unit which can be pushed through the tubular assembly and into the valve on the tank car such that the sealing float of the excess flow check valve can be held in the open position thereby permitting removal of the tank contents via the tubular asembly.

3 Claims, 6 Drawing Sheets

VALVE OPENING DEVICE

FIELD OF THE INVENTION

This invention is directed to a device for use in removing material from an overturned pressure tank car containing the same and to a process of using the equipment.

BACKGROUND OF THE INVENTION

Pressure tank cars (e.g. DOT 112, 114 & 105 spec) are used extensively for the transportation of materials in the liquid or gaseous form, including hazardous materials. When the material is in the liquid or gaseous state, such tank cars are equipped with various safety devices to prevent leakage of such material during loading and unloading operations and to prevent leakage when the tank car is damaged or displaced from its normal position, especially when it is overturned. For a damaged or displaced tank car the problem is how to remove the enclosed material so that it can be transferred to other storage and transportation means should that be necessary. If the tank car is only slightly damaged or displaced from its normal position, such removal can usually be achieved by using the normal valved outlets on the tank car. However, if the normal valved outlets have been damaged or are inaccessible or the tank car has been overturned it is necessary to use other means to remove the material. Tank cars are equipped with usually two liquid valves for loading and unloading, one vapor valve and one safety valve at the loading dome — the two liquid valves are attached to respective eduction lines that reach almost to the bottom of the tank car so that loading and unloading is of the liquid phase. The vapor valve is equipped with a short line so that the end of the line is in the vapor space. When a tank car is overturned the liquid valves cannot be used to remove the contents because the inlet to the line would be in the vapor phase. Hence it is necessary to use the vapor valve. Both the liquid and vapor valves are equipped with excess flow check valves which are closed by either the force of gravity or the flow of fluid at a rate higher than a pre-established value. Thus the removal of liquid through either vapor or liquid valve may be prevented by the excess flow check valve. High pressure inert gas could be applied to the vapor valve of an overturned tank car to displace the excess flow check valve back into the open position to allow the material to be removed through the vapor valve but this frequently fails to work because the subsequent flow of the material through the excess flow check valve causes it to close again, thus stopping the flow of the material. The Applicants are not aware of any prior art directed to overcoming this problem.

SUMMARY OF THE INVENTION

The invention is directed to a device for attachment to a liquid or vapor valve of a pressure tank car for use in the removal of gaseous or liquid material contained in said tank car characterized in that said device comprises a metallic tubular assembly equipped (i) at the downstream end with an externally threaded portion for making engagement with the threaded portion of said valve of said tank car, (ii) at the opposite upstream end with a terminal plug having located therein a leak proof packing gland assembly surrounding a moveable relatively inflexible rod-like elongate unit, said terminal plug being located in an outlet assembly integral with said tubular assembly and having at an angle of 90° to the length of said tubular assembly an outlet pipe having attached at its outer end a valve assembly equipped with an outlet flange, (iii) with a valved gas inlet line attached to said tubular assembly closely adjacent to but downstream of said outlet assembly, and (iv) with a retaining screw means closely adjacent to the downstream end of said tubular assembly, said tubular assembly being internally equipped with at least two web support units fixedly located therein, an upstream web support unit being located downstream of said gas inlet line and a downstream web support unit being located integral with said retaining screw means, said rod-like elongate unit being of length equal to or greater than about 1.5 times the length of said tubular assembly and being moveably located within said tubular assembly from about said downstream end passing through apertures therefore in said web support units and through said packing gland assembly of said terminal plug to outside of the tubular assembly and terminating in a handle means and being equipped within said tubular assembly with a multi-component surrounding guide assembly comprising a first tubular surround fixedly attached to and about said rod-like elongate unit at a point in close proximity to but downstream of said outlet assembly and extending downstream to a point between the two web support units, and an outlet end tubular surround extending from the downstream end of said tubular assembly to a terminal point upstream of said upstream web support unit and having a downstream end outlet at right angles to said tubular surround through which said rod-like elongate unit can be moved, having a downstream stop plate fixedly attached to and located about said tubular surround on the downstream side of said downstream web support unit, having an upstream stop plate fixedly attached to and located about said tubular surround on the upstream side of said downstream web support unit and having a spring means surrounding said outlet end tubular surround from the upstream side of said downstream web support unit to the downstream side of said upstream stop plate, said outlet end tubular surround at its upstream end being located within said first tubular surround and about said rod-like elongate unit.

The invention is also directed to a method of using the aforesaid device for removal of gaseous or liquid material contained in a pressure tank car, said method comprising removing the retaining screw means from the aforesaid device, inserting the downstream end of the tubular assembly through the appropriate aperture of the dome of the tank car and screwing said tubular assembly onto the liquid or vapor valve of the tank car to engage the threaded portion of said tubular assembly with the corresponding threaded portion of said valve such that the retaining screw means will be in alignment with the stem of said valve, inserting the retaining screw means into said tubular assembly, closing the valve of the outlet assembly, attaching to the outlet of the valve of the outlet assembly a pipe-hose system from a storage tank, appropriate container or spare tank car, attaching a gas supply means to the valved gas inlet line of said tubular assembly, supplying inert gas to the assembly to test for leaks, discontinuing the supply of gas when all connections are leakproof, closing the valve of the gas inlet line, opening said valve of the tank car, applying force to the handle means of the rod-like elongate unit to cause it to move within the tubular assembly until movement is no longer readily achievable, tightly screwing in the retaining screw of the retaining screw means to retain the outlet end tubular surround in position, applying a strong force to the handle means thereby forcing the rod-like elongate unit through the open valve of the tank car and into contact with the sealing float of the excess flow check valve located directly beneath said valve such that said sealing float is forced into and held in the open position, and opening the valve of the outlet assembly whereby fluid in the tank car flows out through the excess flow check valve and the valve of the tank car and through the tubular assembly into the pipe-hose system to the storage tank or spare tank car.

DETAILED DESCRIPTION AND PREFERRED EMBODIMENTS

In dealing with an emergency situation, be it an overturned tank car or a damaged tank car, access to the tank car becomes important in order that the material in the tank car can be removed. Once access to the tank car is achieved, it is necessary to connect a pipe or hose to the tank car so that its contents can be removed in a controlled manner. The present invention addresses this need and provides means whereby the tank car contents can be removed and transferred to another vessel in a safe and environmentally proper manner.

The device of this invention basically is attached to the normally closed liquid or vapor valves which are equipped with excess flow check valves and the device is operated so that the sealing float of the excess flow check valve is forced into the open position and the contents of the tank car can then be removed.

The majority of tank cars are equipped, within the dome, with three loading/unloading valves. Two valves, the liquid valves, are attached to respective eduction lines or pipe within the tank car for the supply of the material into or out of the tank car. The pipe attached to these valves reaches close to the bottom of the tank car so that material fed into it does not have to fall through a great distance. These valves are also used for the removal of material from the tank car so that material removed is taken from the liquid phase. If the tank car is overturned, the bottom of the pipe connected to these valves would be, at least part of the time, in the vapor phase not the liquid phase. The third valve (the vapor valve) is connected to an inert gas supply (when material is being removed) or to a recycle means (when material is being fed into the tank car). All three valves are equipped with excess flow check valves in which the sealing floats are designed to operate above certain pre-determined flow rates.

Figure 1:
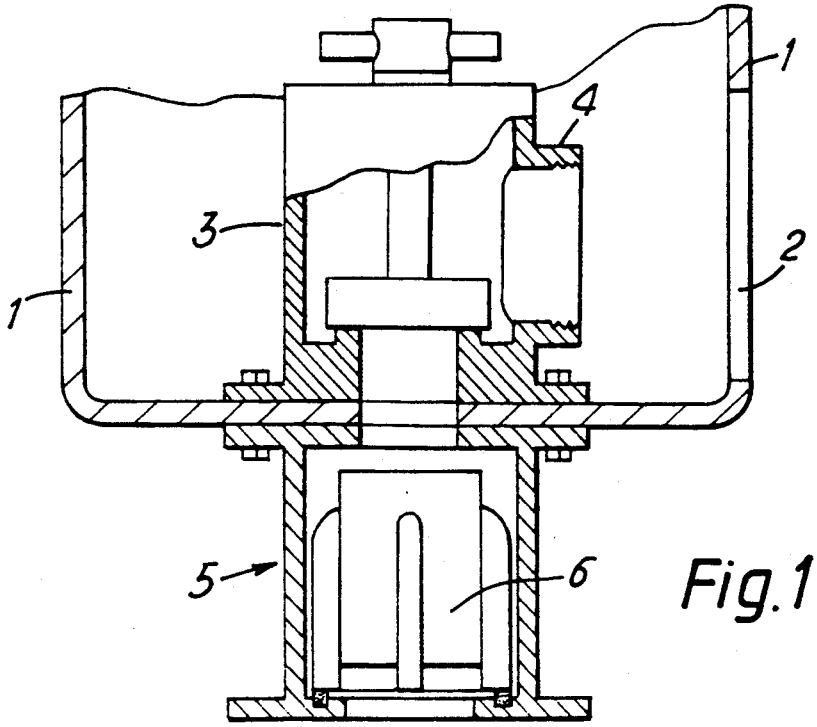
FIG. 1 is a schematic illustration of a safety valve in a dome of a tank car.
Figure 2A:
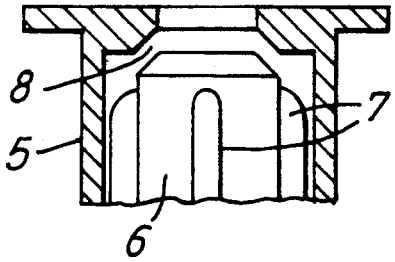
FIGS. 2(*a*) and 2(*b*) are schematic illustrations of sealing floats as used in excess flow check valves.
Figure 2B:
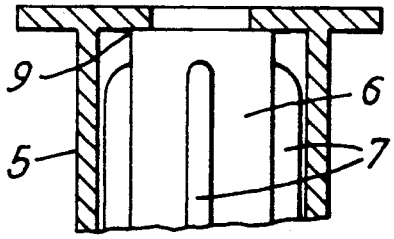
Figure 3:
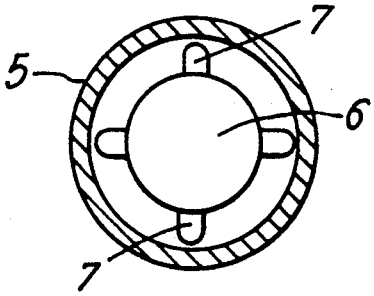
FIG. 3 is a schematic illustration of a cross-section of a sealing float of an excess flow check valve.

The device and operation of the device is described with reference to the Figures in which like parts have like identifying numbers. FIG. 1 is an illustration of a valve located within the dome of a tank car. The outer shell of the dome 1 has at least three apertures 2 through which lines can be connected to the valves therein. The valve 3 has a threaded portion 4 to which connections can be made. Located underneath the safety valve is an excess flow check valve 5 equipped with a sealing float 6. FIGS. 2(*a*) and 2(*b*) show alternative configurations of the excess flow check valve with the sealing float being equipped with an angled surface 8 (see FIG. 2(*a*)) for mating engagement by the sealing float or with a flat surface 9 (see FIG. 2(*b*)) for mating engagement by the sealing float. The sealing float is equipped with vanes 7 to locate it within the excess flow check valve and provide space for the fluid to flow through, FIG. 3.

Figure 4:
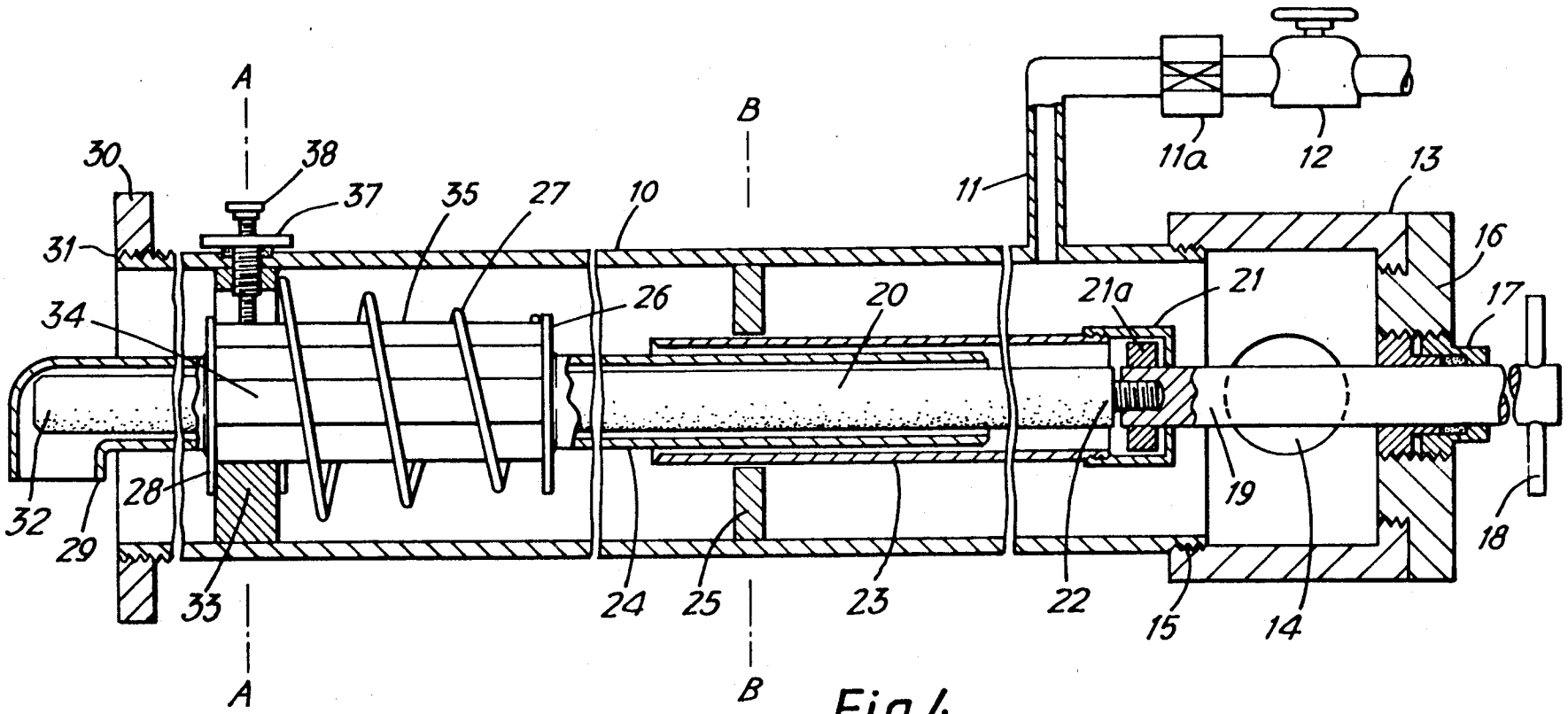
FIG. 4 is a schematic illustration of the device of the present application.
Figure 7:
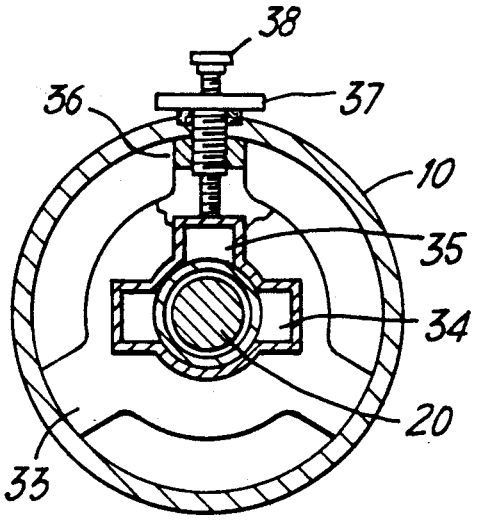
FIG. 7 is a schematic illustration of the cross-section A—A of FIG. 4.
Figure 8:
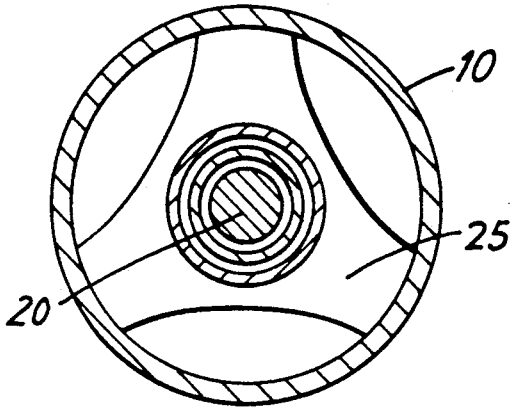
FIG. 8 is a schematic illustration of the cross-section B—B of FIG. 4.
Figure 9:
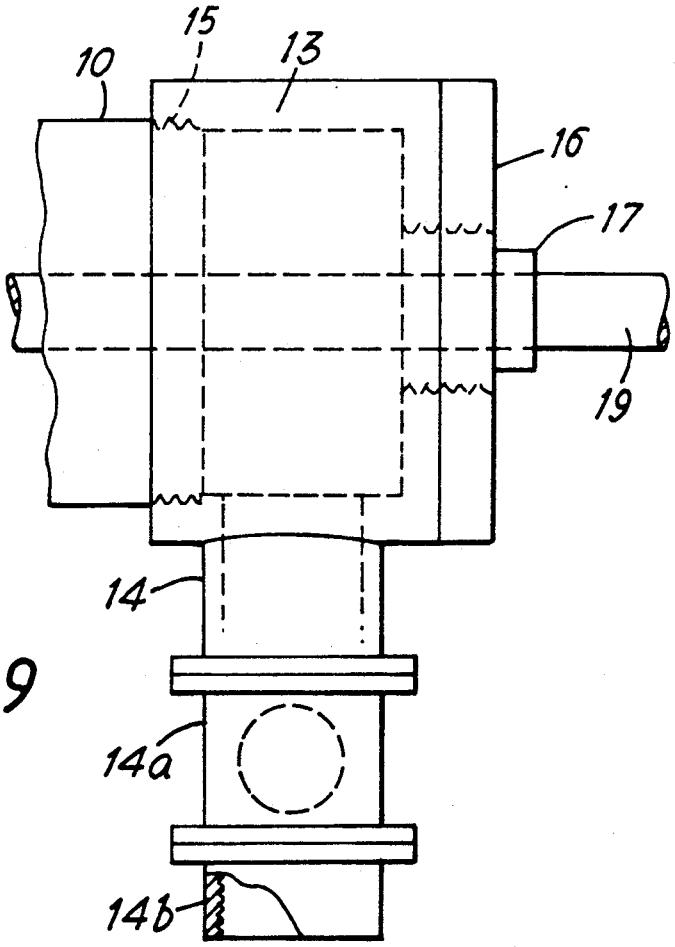
FIG. 9 is a schematic illustration of the outlet assembly of the device of FIG. 4.

FIG. 4 is an illustration of a preferred embodiment of the device of this invention. The metallic tubular assembly 1 is equipped at the downstream end with a threaded portion 31 and a locking nut 30 engaged by said threaded portion. The upstream end is equipped with a terminal plug 16 having a leak proof packing gland assembly 17 which surrounds a moveable relatively inflexible rod-like elongate unit 19 and 20. This elongate unit is preferably made of metal at portion 19 and of a strong plastic at section 20 and is of a length equal to or greater than about 1.5 times the length of the tubular assembly. The elongate unit has a handle means 18 by means of which pressure may be applied in order to move the elongate unit through the tubular assembly. The terminal plug is located in an outlet assembly 13 which is integral with the tubular assembly and connected thereto at 15. The outlet assembly is equipped with an outlet pipe 14 and as shown in FIG. 9 has at the outer end of the outlet pipe and attached thereto a valve assembly 14*a* with an outlet flange or, as shown, a threaded portion 14*b* to which may be connected a hose-pipe (not shown). The tubular assembly is equipped with a valved gas inlet line 11 which has a check valve 11*a* and valve 12 which is used to open or close access to an inert gas. The valved gas inlet line is located closely adjacent to but downstream of said outlet assembly and preferably is at an angle of 90° to the outlet pipe 14. The tubular assembly is equipped with at least two, and preferably only two, web support units 25 and 33 which are fixedly located within the tubular assembly. An upstream web support unit 25 is located downstream of said gas inlet line 11 and a downstream web support unit 33 is located integral with a retaining screw means 36. The retaining screw means 36 is located closely adjacent to the downstream end of the tubular assembly and comprises an insert screw means 37 removably inserted into the wall of the tubular assembly 10, preferably equipped with a gasket or similar means to provide a leak proof seal, and a retaining screw 38 which is rotatably moveable in the insert screw means so that its inside end can be brought into contact with the outlet end tubular surround 24. FIG. 7 is a cross section taken through the tubular assembly at A—A shown on FIG. 4 and illustrates the retaining screw means 36 and the associated downstream web support unit 33. The web support unit 33 is essentially a three armed unit fixedly located within the tubular assembly 10 and has a central aperture through which the elongate unit 20 and the outlet end tubular surround 24 passes. One of the three arms contains the retaining screw means 36 with the retaining screw 38 passing through such that its inside end can be brought into contact with the outlet end tubular surround 24 at the point where one of the strengthening members 35 is attached. FIG. 8 is a cross-section taken through the tubular assembly at B—B shown on FIG. 4 and illustrates the upstream web support unit 25 fixedly located within the tubular assembly 10 and being a three armed unit having a central aperture through which the elongate unit 20 passes. On FIG. 4, the rod-like elongate unit is shown as comprised of section 19 and section 20, section 19 being the upstream portion thereof and being of metallic construction. Section 20 is the downstream portion and is of a high strength relatively inflexible plastic such as polypropylene. Sections 19 and 20 are joined at 22 by a male threaded portion of section 20 being engaged in a matching female threaded portion of section 19. Close to the downstream end of section 19 is an attachment 21*a* which is fixedly attached to the outside of section 19 and which is of sufficient diameter that it cannot be removed from within the attaching screw means 21. The elongate unit is equipped with a multi-component surrounding guide assembly which comprises a first tubular surround 23 which is fixed attached to and about said elongate unit by attaching screw means 21 and which is of sufficient diameter to pass through the aperture in the upstream web support means 25. A further component of the surrounding guide assembly is an outlet end tubular surround 24 which extends from the downstream end of the tubular assembly to a terminal point upstream of said upstream web support unit 25. The outlet end tubular surround has a downstream end outlet 29 which is at right angles to said tubular surround and through which the rod-like elongate unit can be moved. The tubular surround 24 has a downstream stop plate 28 which is fixedly attached to and located about said tubular surround on the downstream side of the downstream web support unit 33 and has an upstream stop plate 26 which is fixedly attached to and located about said tubular surround on the upstream side of said downstream web support unit 33. The outlet end tubular surround 24 has a spring means 27 surrounding it from the upstream side of the downstream web support unit 33 to the downstream side of the upstream stop plate 26. The outlet end tubular surround at its upstream end is located within the first tubular surround 23 and is about the rod-like elongate unit 20. Preferably the outlet end tubular surround is equipped with three reinforcing strips 34 and 35 (only two shown), two reinforcing strips 34 being located one on either side at positions equivalent to three o'clock and nine o'clock and one reinforcing strip 35 being located at a position equivalent to twelve o'clock. These reinforcing strips are also shown on FIG. 7. The rod-like elongate unit terminates at 32.

Figure 5:
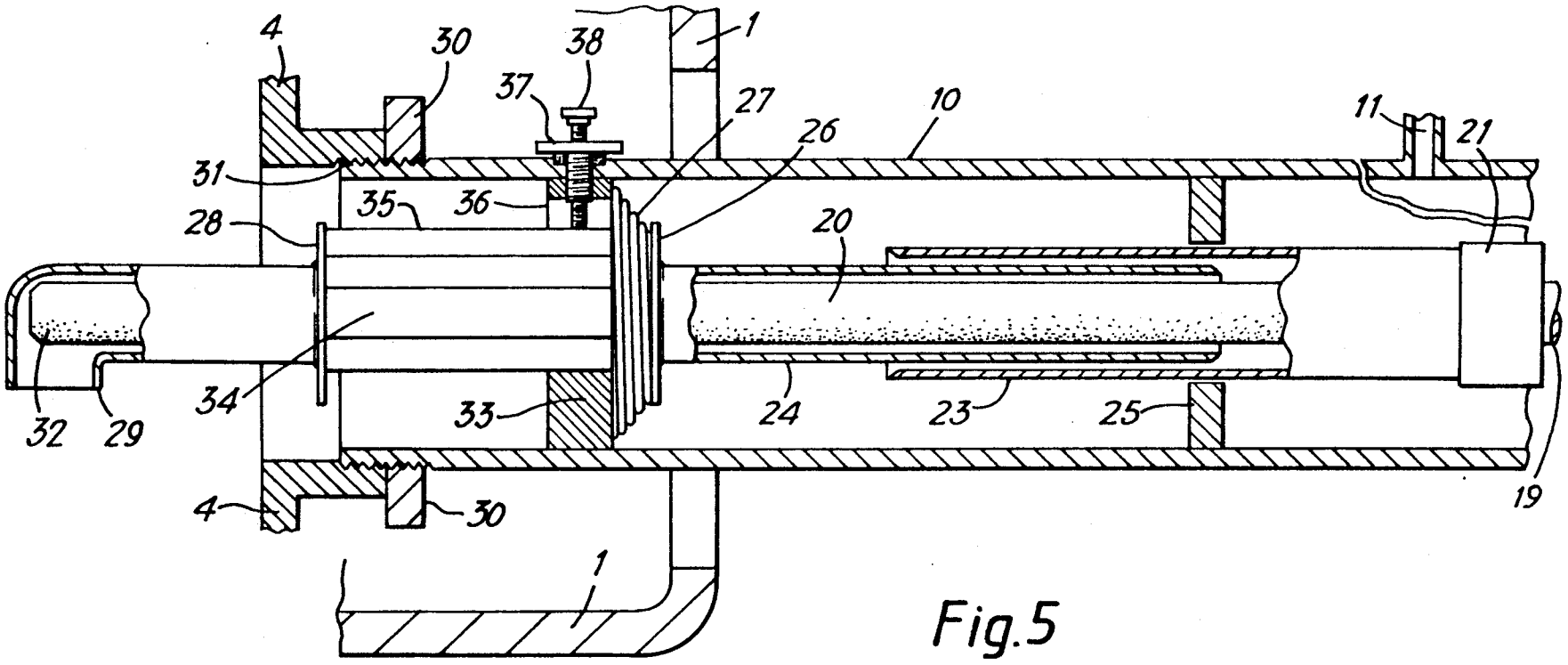
FIG. 5 is a schematic illustration of the device of the present application in a partially operating condition.

Referring now to FIG. 5, which is an illustration of the device in a partially operating condition, the device is shown attached to the valve with the outlet end tubular surround 24 located in the throat of the valve. The device is shown attached at its threaded portion 31 to the threaded portion 4 of the valve (not shown) with the locking nut 30 of the tubular assembly in place. By applying pressure to the handle means 18 (not shown) of the elongate unit, the elongate unit and its associated multi-component surrounding guide assembly has been moved in the downstream direction until the spring means 27 is essentially fully compressed and the downstream end outlet 29 of the outlet end tubular surround is located outside of the tubular assembly and within the throat of the valve, as further shown in FIG. 10. The end 32 of the rod-like elongate unit is located in close proximity to the outlet 29 of the outlet and tubular surround. The retaining screw 39 of the retaining screw means 36 is rotated so that the inside end is brought into contact with the outlet end tubular surround 24 at a point where reinforcing strip 35 is located thereon, the retaining screw being sufficiently tightened to stop movement of the tubular surround 24.

Figure 6:
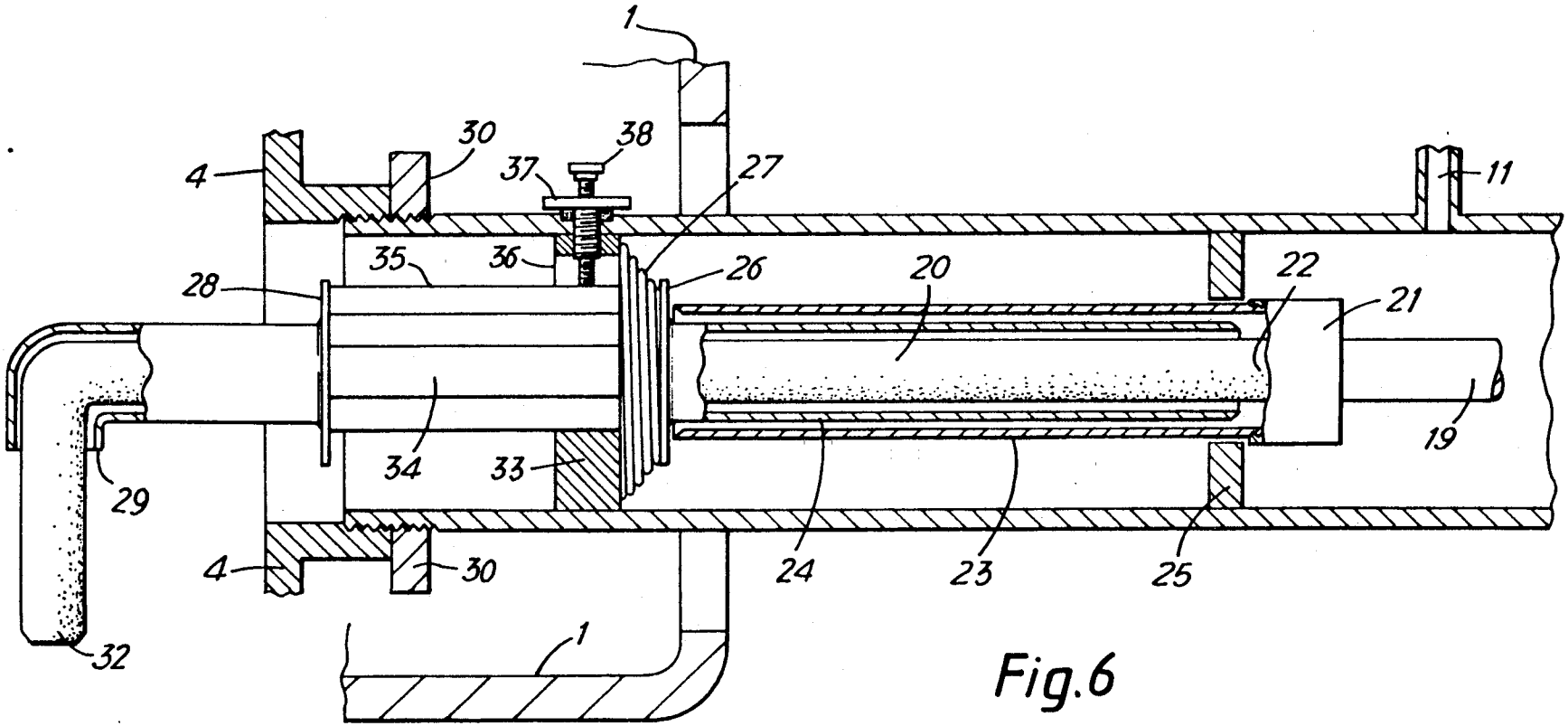
FIG. 6 is a schematic illustration of the device of the present application in a fully operating condition.
Figure 11:
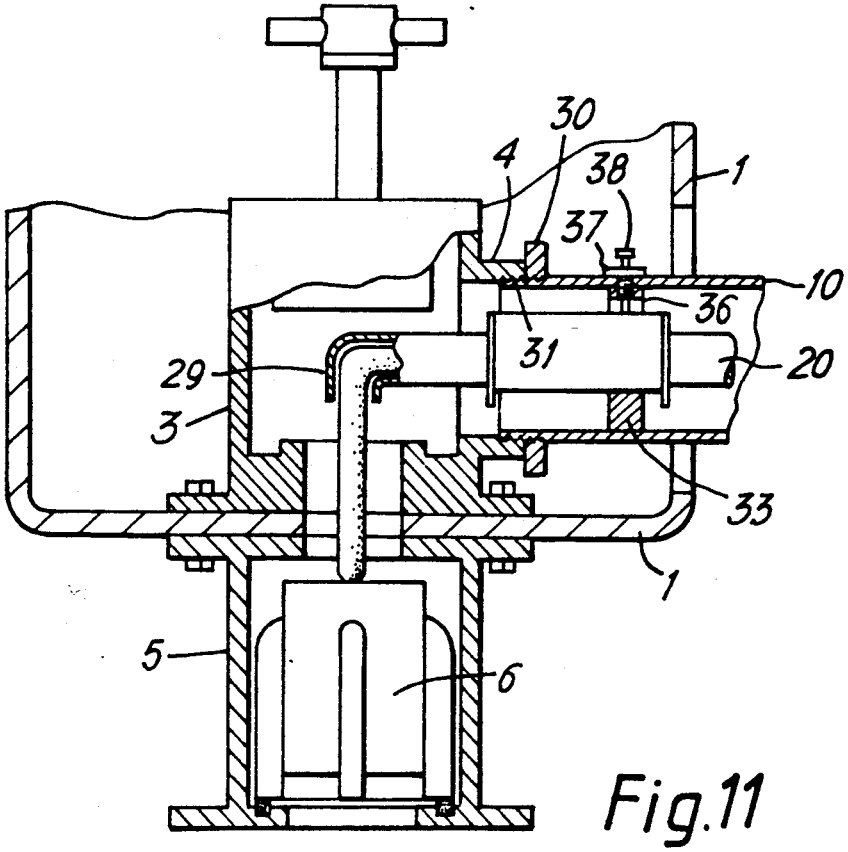
FIG. 11 is a schematic illustration of the downstream end of the inventive device screwed into the valve of the tank car with the rod-like elongate unit extended to retain the sealing float of the excess flow check valve in the open position, in the fully operating condition.

Referring now to FIG. 6, which is an illustration of the device in a fully operating condition, the device is shown attached to the valve with the elongate unit fully introduced into the valve (not shown) and forcing the sealing float of the excess flow valve into the open position as shown in FIG. 11. This has been achieved by applying a strong force to the handle means of the elongate unit to force it to move as far as possible within the device.

Figure 10:
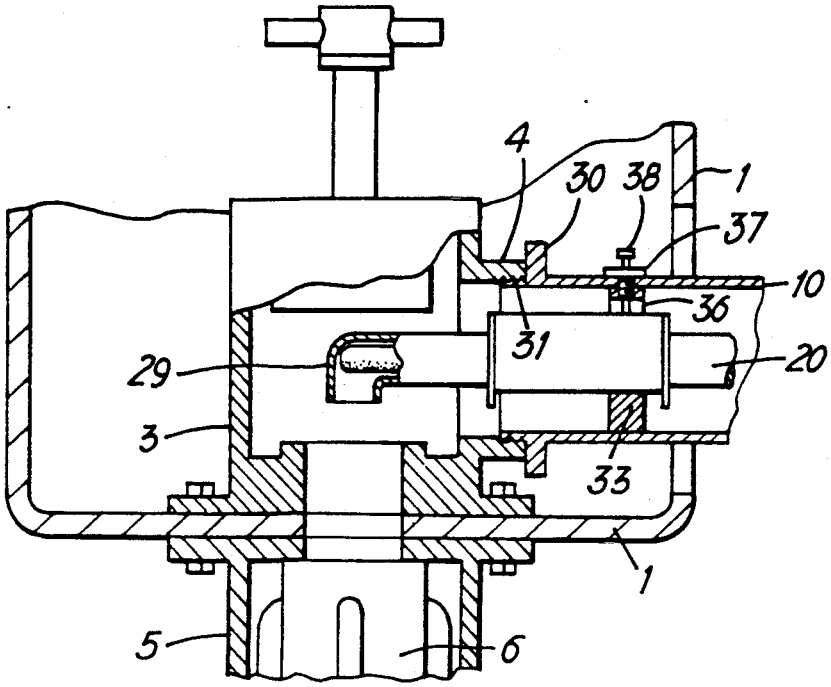
FIG. 10 is a schematic illustration of the downstream end of the inventive device screwed into the valve of the tank car in the partially operating condition.

Referring now to FIG. 10, the downstream end of the device is shown attached to the valve. The device has been inserted through one of the apertures of the outer shell of the dome 1 of the tank car, the retaining screw means 36 having been removed and, after the tubular device is screwed onto the valve and suitably aligned with said valve stem, then replaced. The outlet end tubular surround is shown located in the throat of the valve. The sealing float 6 of the excess flow check valve 5 is shown in the closed position. FIG. 11 illustrates the downstream end of the device attached to the valve, with the rod-like elongate unit now fully inserted through the valve and into the excess flow check valve 5 forcing the sealing float 6 downward and thus in the open position whereby fluid from the tank car can now flow out, through the tubular assembly, through the outlet assembly, through the valve assembly 14*a* into a hose-pipe system connected thereto and into a storage tank or spare tank car.

To operate the present device to remove fluid from an overturned tank car, the lid of the dome of the tank car is opened or removed so as to provide access to the valves located within the dome. The retaining screw means is removed from the tubular assembly which is then pushed through the aperture in the dome and screwed onto the selected valve and aligned with the valve stem and the locking nut, if present, screwed into a tight fit. The tubular assembly is preferably aligned so that the valved gas inlet line is essentially in line with said valve stem. The retaining screw means is then inserted back into the tubular assembly and screwed in tightly to provide a gas-tight fit. The valve on the outlet assembly is closed and a pipe-hose system from a storage tank or spare tank car is attached to the valve of the outlet assembly. An inert gas supply means is attached to the valved gas inlet line and gas is supplied to the assembly which is tested, for example by use of a soap solution, for leaks. If any leaks are detected the junctions at the point of leakage are tightened until the leakage is eliminated. When all connections are leak proof, the valve of the gas inlet line is closed and the supply of gas is discontinued. The valve on the tank car is opened and force is applied to the handle means of the rod-like elongate unit to cause it to move within the device until movement is no longer readily achievable which is when the spring means has been essentially fully compressed. The retaining screw of the retaining screw means is now tightly screwed into the retaining screw means so as to retain in position the outlet end tubular surround. At this point, the spring means has been compressed and the downstream end outlet of the outlet end tubular surround is located within the throat of the valve as shown in FIG. 10. The retaining screw holds the assembly in this configuration. A strong force is applied to the handle means, such as a strong sharp blow, which forces the rod-like elongate unit out of the end outlet of the outlet end tubular surround, through the open valve and into contact with the sealing float of the excess flow check valve so that the sealing float is forced into and held in the open position. In the event that the sealing float does not open adequately, high pressure inert gas can be applied through the valved gas inlet line 11, FIG. 4, to bump the float off its seat, following which the elongate unit will hold it in the open position. The valve of the outlet assembly is then opened which causes the fluid in the overturned tank car to flow out through the excess flow check valve and its associated valve, through the tubular assembly and into the pipe-hose system and to the storage tank or spare tank car. When the overturned tank car is emptied of its contents, the valve of the outlet assembly is closed, the pipe-hose system is detached therefrom, the rod-like elongate unit is pulled back into the tubular assembly until movement is no longer readily achievable at which point the assembly has the configuration shown in FIG. 5 and FIG. 10. The retaining screw of the retaining screw means is then loosened and the rod-like elongate unit pulled back to its starting position with the configuration shown in FIG. 4. The valve on the tank car is closed, the retaining screw means is removed from the tubular assembly and the tubular assembly is unscrewed from the valve of the tank car.

Typically, the tubular assembly is a two inch diameter carbon steel pipe, the gas inlet line is a one half inch pipe, the rod-like elongate unit is one half inch rod for the metal section and 5/16 inch rod for the plastic section, the outlet assembly is a two inch pipe tee, the first tubular surround is one half inch nominal internal diameter metal pipe and the outlet end tubular surround is one half inch external diameter, ⅜ inch internal diameter metal pipe. Typically, the tubular assembly is about two feet long.

What is claimed is:

1. A device for attachment to a liquid or vapor valve having a threaded portion and located in a dome of a pressure tank car for use in removal of gaseous or liquid material contained in said tank car characterized in the said device comprises a metallic tubular assembly, having an upstream and a downstream end, equipped (i) at the downstream end with an externally threaded portion for making engagement with the threaded portion of said valve of said tank car, (ii) at the opposite upstream end with a terminal plug having located therein a leak proof packing gland assembly surrounding a moveable relatively inflexible rod-like elongate unit, said terminal plug being located in an outlet assembly integral with said tubular assembly and at an angle of 90° to the length of said tubular assembly, said outlet assembly is equipped with an outlet pipe having attached at its outer end a valve assembly equipped with an outlet flange, (iii) with a valved gas inlet line attached to said tubular assembly closely adjacent to but towards the downstream end of said outlet assembly, and (iv) with a retaining screw means closely adjacent to the downstream end of said tubular assembly, said tubular assembly being internally equipped with at least two web support units fixedly located therein, an upstream web support unit being located downstream of said gas inlet line and a downstream web support unit being located integral with said retaining screw means, said rod-like elongate unit being of length equal to or greater than about 1.5 times the length of said tubular assembly and being moveably located within said tubular assembly from about said downstream end passing through apertures in said web support units and through said packing gland assembly of said terminal plug to outside of the tubular assembly and terminating with a handle means and being equipped within said tubular assembly with a multi-component surrounding guide assembly comprising a first tubular surround fixedly attached to and about said rod-like elongate unit at a point in close proximity to but downstream of said outlet assembly and extending downstream to a point between the two web support units, and an outlet end tubular surround extending from the downstream end of said tubular assembly to a terminal point upstream of said upstream web support unit and having a downstream end outlet at right angles to said tubular surround through which said rod-like elongate unit can be moved, having a downstream stop plate fixedly attached to and located about said tubular surround on the downstream side of said downstream web support unit, having an upstream stop plate fixedly attached to and located about said tubular surround on the upstream side of said downstream web support unit and having a spring means surrounding said outlet end tubular surround from the upstream side of said downstream web support unit to the downstream side of said upstream stop plate, said outlet end tubular surround at its upstream end being located within said first tubular surround and about said rod-like elongate unit.

2. The device for attachment to a liquid or vapor valve of a pressure tank car of claim 1 wherein the outlet end tubular surround is equipped with three reinforcing strips.

3. A method using the device of claim 1 for the removal of gaseous or liquid material contained in a pressure tank car, which method comprises removing the retaining screw means from said device, inserting the downstream end of the tubular assembly through the appropriate aperture of the dome of the tank car and screwing said tubular assembly onto the liquid or vapor valve of the tank car to engage the threaded portion of said tubular assembly with the corresponding threaded portion of said valve such that the retaining screw means will be in alignment with the stem of said valve, inserting the retaining screw means into the tubular assembly, closing the valve of the outlet assembly, attaching to the outlet flange of the valve of the outlet assembly a pipe-hose system from a storage tank, appropriate container or a spare tank car, attaching a gas supply means to the valved gas inlet line of said tubular assembly, supplying inert gas to the assembly to test for leaks, discontinuing the supply of gas when all connections are leakproof, closing the valve of the gas inlet line, opening said valve of the tank car, applying force to the handle means of the rod-like elongate unit to cause it to move within the tubular assembly until movement is no longer readily achievable, tightly screwing in the retaining screw of the retaining screw means to retain the outlet end tubular surround in position, applying a strong force to the handle means thereby forcing the rod-like elongate unit through ,the open valve of the tank car and into contact with a sealing float of an excess flow check valve located directly beneath said valve such that said sealing float is forced into and held in the open position, and opening the valve of the outlet assembly whereby fluid in the tank car flows out through the excess flow check valve and the valve of the tank car and through the tubular assembly into the pipe-hose system to the storage tank or spare tank car.

* * * * *